US011285074B2

(12) United States Patent
Qiu et al.

(10) Patent No.: US 11,285,074 B2
(45) Date of Patent: Mar. 29, 2022

(54) MASSAGE APPARATUS

(71) Applicant: AITREAT PTE. LTD., Singapore (SG)

(72) Inventors: Chen Qiu, Singapore (SG); Yizhong Zhang, Singapore (SG); Lui Kai, Singapore (SG)

(73) Assignee: AITREAT PTE, LTD., Farrer Park Gardens (SG)

( * ) Notice: Subject to any disclaimer, the term of this patent is extended or adjusted under 35 U.S.C. 154(b) by 236 days.

(21) Appl. No.: 16/753,113

(22) PCT Filed: Oct. 3, 2018

(86) PCT No.: PCT/SG2018/050501

§ 371 (c)(1),
(2) Date: Apr. 2, 2020

(87) PCT Pub. No.: WO2019/070198

PCT Pub. Date: Apr. 11, 2019

(65) Prior Publication Data

US 2020/0281805 A1 Sep. 10, 2020

(30) Foreign Application Priority Data

Oct. 3, 2017 (SG) ..... 10201708113U

(51) Int. Cl.
*A61H 15/00* (2006.01)

(52) U.S. Cl.
CPC . *A61H 15/0078* (2013.01); *A61H 2201/0107* (2013.01); *A61H 2201/1215* (2013.01);
(Continued)

(58) Field of Classification Search
CPC ..... A61H 15/0078; A61H 2201/0107; A61H 2201/1215; A61H 2201/1436;
(Continued)

(56) References Cited

U.S. PATENT DOCUMENTS 10,034,814 B2 * 7/2018 Zhang ..... A61H 39/007
2001/0014781 A1 * 8/2001 Nissim ..... A61H 7/001 601/133

(Continued)

FOREIGN PATENT DOCUMENTS

JP 2003135547 A * 5/2003
JP 2003135547 A 5/2003
WO 2017156821 A1 9/2017

OTHER PUBLICATIONS

International Search Report for PCT/SG2018/050501 dated Mar. 14, 2019.

(Continued)

*Primary Examiner* — Samchuan C Yao
*Assistant Examiner* — Tyler A Raubenstraw
(74) *Attorney, Agent, or Firm* — Muir Patent Law, PLLC

(57) ABSTRACT

The present invention relates to a massage apparatus. More particularly, the invention relates to a massage apparatus which maintains the applied force of a massage head. The apparatus has massage head that is attached to a movable block. The movable block can be repositioned to apply force to a subject. A force sensor constantly transmits applied force readings to a microprocessor which maintains the applied force by adjusting the position of the movable block relative the subject's body.

10 Claims, 5 Drawing Sheets

(52) U.S. Cl.
CPC ..... *A61H 2201/1436* (2013.01); *A61H 2201/1671* (2013.01); *A61H 2201/5061* (2013.01)

(58) Field of Classification Search
CPC ..... A61H 2201/5061; A61H 7/004; A61H 7/007; A61H 15/00; A61H 39/00; A61H 39/04
See application file for complete search history.

(56) References Cited

U.S. PATENT DOCUMENTS

2004/0260211 A1* 12/2004 Maalouf ..... A61H 23/02 601/15
2005/0090771 A1* 4/2005 Miki ..... A61H 7/007 601/99
2005/0096571 A1* 5/2005 Miki ..... A61H 15/0078 601/99
2010/0268132 A1* 10/2010 Wu ..... A61H 7/007 601/98
2010/0286569 A1* 11/2010 Nagano ..... A61H 1/008 600/587
2013/0041296 A1 2/2013 Tass et al.
2015/0182411 A1* 7/2015 Lin ..... A61H 15/0078 601/102
2016/0046028 A1 2/2016 Meier et al.
2017/0049164 A1* 2/2017 Gruentzig ..... A41D 1/002
2017/0266077 A1* 9/2017 Mackin ..... A61G 13/125

OTHER PUBLICATIONS

Written Opinion for PCT/SG2018/050501 dated Mar. 14, 2019.
Second Written Opinion for PCT/SG2018/050501 dated Feb. 19, 2020.

* cited by examiner

MASSAGE APPARATUS

FIELD OF THE INVENTION

The present invention relates to a massage apparatus. More particularly, the invention relates to a massage apparatus which maintains the applied force of a massage head.

BACKGROUND

Massage therapy serves as an alternative treatment modality for individuals seeking relief from strains and aches that is complementary to services offered by physiotherapists and Chinese physicians. Ailments that may be treated by a massage therapist include sports-related injuries such as muscle pulls, stiff neck and shoulders, along with chronic conditions such as lower back pain amongst others. However the provision of therapeutic massages is hindered by a shortage of trained therapists, hence there has been sustained interest in developing automated massage apparatuses that may serve as a substitute for human massage therapists.

Massage chairs currently marketed and sold while able to provide a massage-like effect are not able to adequately replicate a massage experience delivered by a human therapist. Another approach that has been explored is the use of robotic limbs with a massage head as an end effector. This is exemplified in CN203694079U which discloses a mechanical arm that drives a massage head to press the soft tissue of a patient's body, where the application of the force stops when the massage force reaches a certain value. The use of a mechanical arm to exert pressure on the human body poses potential safety issues particularly in the event of a malfunction since it is generally capable of exerting a force sufficient to inflict injury on a patient.

A need therefore exists for a robotic limb capable of providing a massage experience similar to that of massage therapists in a manner that ensures the safety of the subject is not compromised.

SUMMARY OF THE INVENTION

The details of one or more embodiments are set forth in the accompanying drawings and the description below. Other features, objects, and advantages of the invention will be apparent from the description and drawings, and from the claims.

The primary embodiment of the invention is a massage apparatus comprising a support structure, a movable block movably disposed within the support structure, a massage head attached to the movable block, a force sensor and a microcontroller. The microcontroller is configured to dynamically reposition the movable block along an axis to maintain an applied force within a predetermined range in response to applied force readings transmitted by the force sensor.

In an optional design of the primary embodiment, the movable block comprises an outer stage and an inner stage that are compressible towards each other along the axis.

DETAILED DESCRIPTION OF THE INVENTION

In the following detailed description, reference is made to the accompanying drawings, which form a part hereof. The illustrative embodiments described in the detailed description, drawings and claims are not meant to be limiting. Other embodiments can be utilized, and other changes can be made, without departing from the spirit or scope of the subject matter presented herein.

The massage apparatus may form part of a larger system for example, a robotic massage system where the massage apparatus is mounted to a robotic limb and serves as the end effector. In other words the massage apparatus serves as a device located at the end of a robotic limb that interacts with the environment, which in the context of the present invention is typically the subject's body. When employed in this manner, the robotic limb serves to guide the massage apparatus to a position that is proximate to the subject's body. Direct contact with the patient's body for safety reasons, is not achieved by way of the robotic limb but instead by the massage apparatus itself. However once contact is achieved, the robot arm moves the massage apparatus across the surface of the patient's body, that is movement that is parallel to the longitudinal axis of the subject's body while contact pressure is determined by the massage apparatus. Alternatively, the massage apparatus can be hand operated where an operator positions the apparatus close to or in contact with the patient. It is envisaged that multiple massage apparatuses may be connected to a single robotic limb.

Figure 1:
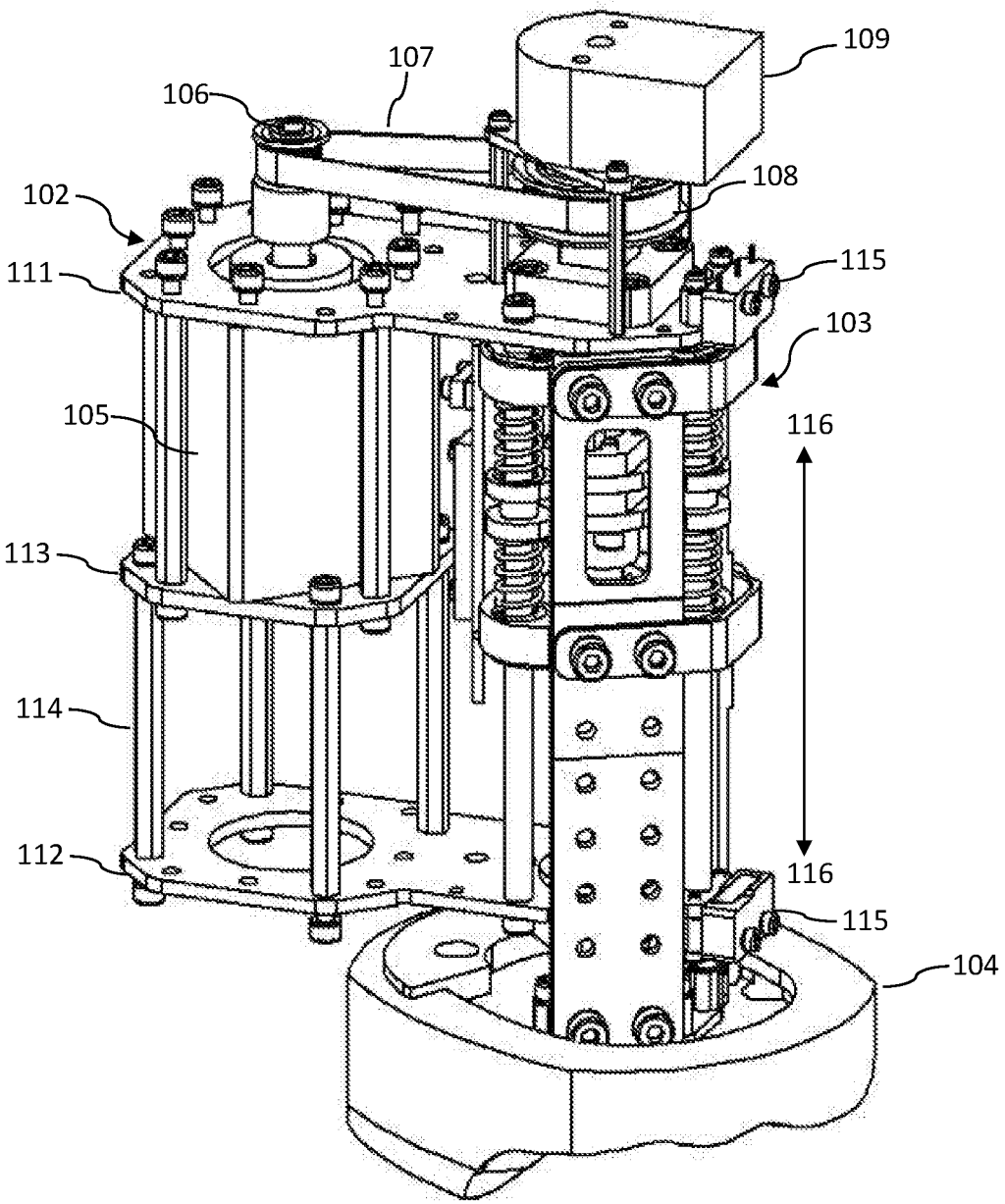
FIG. 1 depicts a perspective view of the massage apparatus according to the primary embodiment of the invention.
Figure 2:
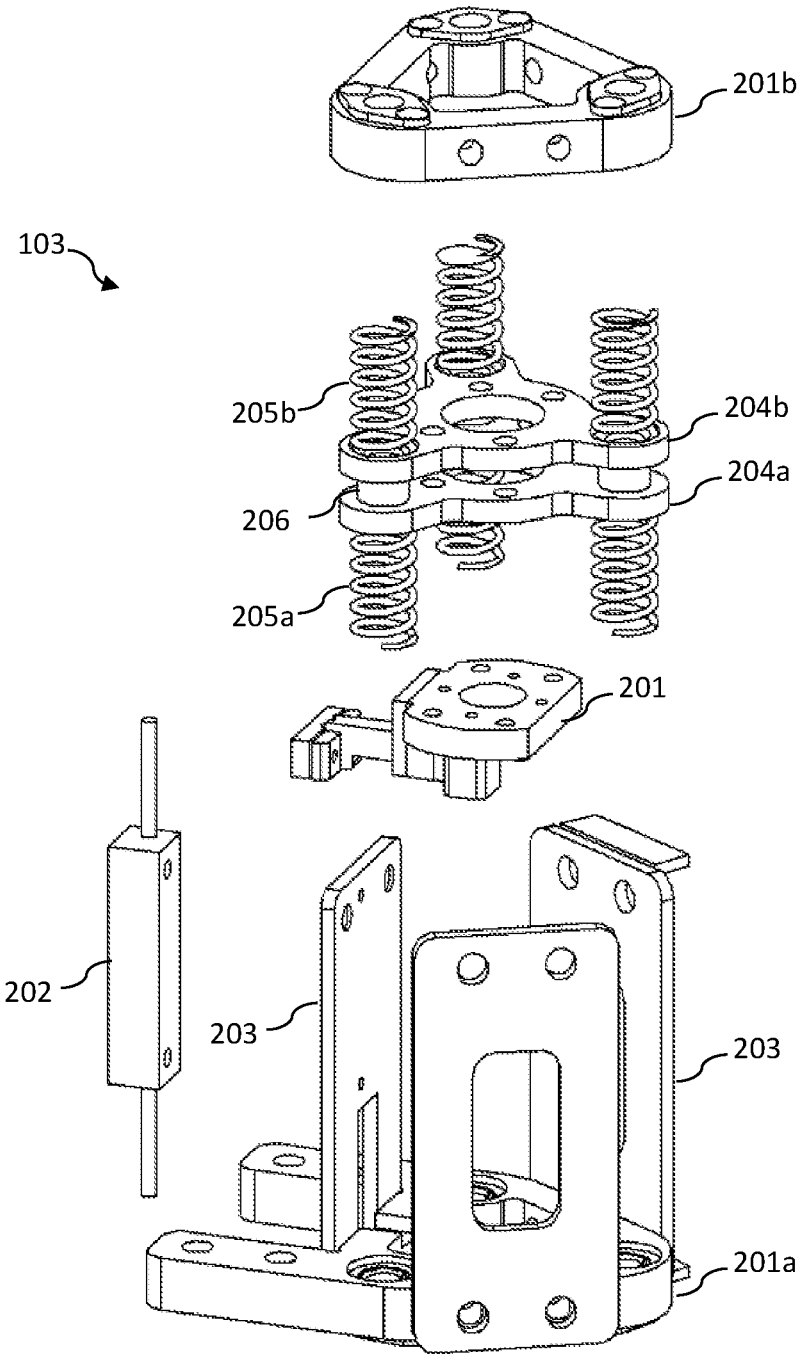
FIG. 2 depicts an exploded view of the movable block and associated components.

Referring to FIGS. 1 and 2, the primary embodiment of the invention is a massage apparatus comprising a support structure 102, a movable block 103 movably disposed within the support structure, a massage head 104 attached to the movable block 103, a force sensor 202 and a microcontroller (not depicted).

The support structure comprises an upper segment 111 and a lower segment 112 connected by support columns 114. A middle segment serves as an attachment point for a reversible motor 105.

The movable block 103 comprises an outer stage 201*a*, and mounting brackets 203 for attaching the massage head 104 and an attachment point such as nut 201 to allow the fastening of the movable block 103 to a mechanism which enables movement of the movable block 103 along at least axis 116. While the drawings depict the mechanism as being a ball screw (not depicted) and nut 201, alternatives such as a lead screw, pulley and belt, gear and threaded rod and linear track gear pair may be employed. It will be readily understood by a skilled addressee that any mechanism that permits movement along axis 116 can be used. Motive force for the movable block 103 is provided by a transmission comprising a reversible motor 105, pulleys 106 and 108 and belt 107 which impart rotational movement to the ball screw having a longitudinal axis parallel to axis 116.

As the ball screw rotates, its rotational motion is converted to linear motion causing the nut 201 and hence the movable block 103 to move along axis 116. When placed under control of the microcontroller, the movable block 103 can make contact with the subject's body in a controlled manner independent from that of the robotic limb it may be attached to. Once contact is made, further movement of the nut 201 towards the subject's body will increase the applied force exerted till it is within a predetermined range. Applied force typically ranges for 20-80N during regulation operation. The force sensor 202 also known as a force-sensitive resistor constantly measures the force applied to the subject's body and transmits the readings to the microcontroller configured to keep the applied force within a predetermined range. In some embodiments the force sensor 202 is away from the movable block 103 and is instead functionally disposed within massage head 114. Should applied force readings start to fall outside the predetermined range, the microcontroller can reposition the movable block 103 to decrease or increase the applied force such that it is once again within the predetermined range. This predetermined range may be adjusted automatically or manually during the course of the massage routine. Applied force readings are constantly transmitted during operation, which permits rapid response to prevailing conditions. The applied force exerted on a patient can change due to variations of the target massage area. This can occur for example when the massage head that was previously in contact with an area of the body with relatively high levels of subcutaneous adipose tissue makes a sudden transition to a region where the bone structure is more prominent where if the applied force is not reduced, which may result in discomfort and possibly harm to the patient.

In some embodiments, the movable block 103 may comprise an inner stage 204*a* that is compressible towards the outer stage 201*a* along axis 116. Compressibility may be achieved by way of an elastic means 205*a* set in between the inner stage 204*a* and outer stage 201*a*. The elastic means 205*a* may be a coil spring such as a compression spring. In some embodiments, the movable block 103 may further comprise an additional set consisting of an outer stage 201*b*, inner stage b and elastic means 205*b* where a spacer 206 separates inner stages 204*a* and *b* and where the outer stages 201*a* and *b* and orientated in opposite directions along the axis 116. The compressibility of the stages 201*a* and 204*a* affords the movable block 103 with a measure of compliance to smoothen sudden changes in applied force encountered during the course of a massage. When used in conjunction with the adaptive measures employed by continuously varying the position of the movable block 103 in response to force sensor readings, the compliant movable block 103 minimises potential harm to the patient which may otherwise result from sudden and unexpected increases in applied force. The belt 107 serves as a physical failsafe in the event other safety features are compromised by selecting belts 107 that are capable of deforming and/or snapping when the force applied to the subject's body exceeds a predefined value, resulting in a break in the transmission of motive force thus preventing injury to the patient's body. A predefined value of approximately 150N is preferable. However a skilled addressee would understand that a human subject's pain tolerance may vary significantly.

In other embodiments that employ a compliant movable block 103, the force sensor 202 may measure the deflection of the elastic means 205*a* and *b* as an alternative to measuring the applied force directly so long as the elastic means 205*a* and *b* demonstrates linear elasticity.

Figure 3:
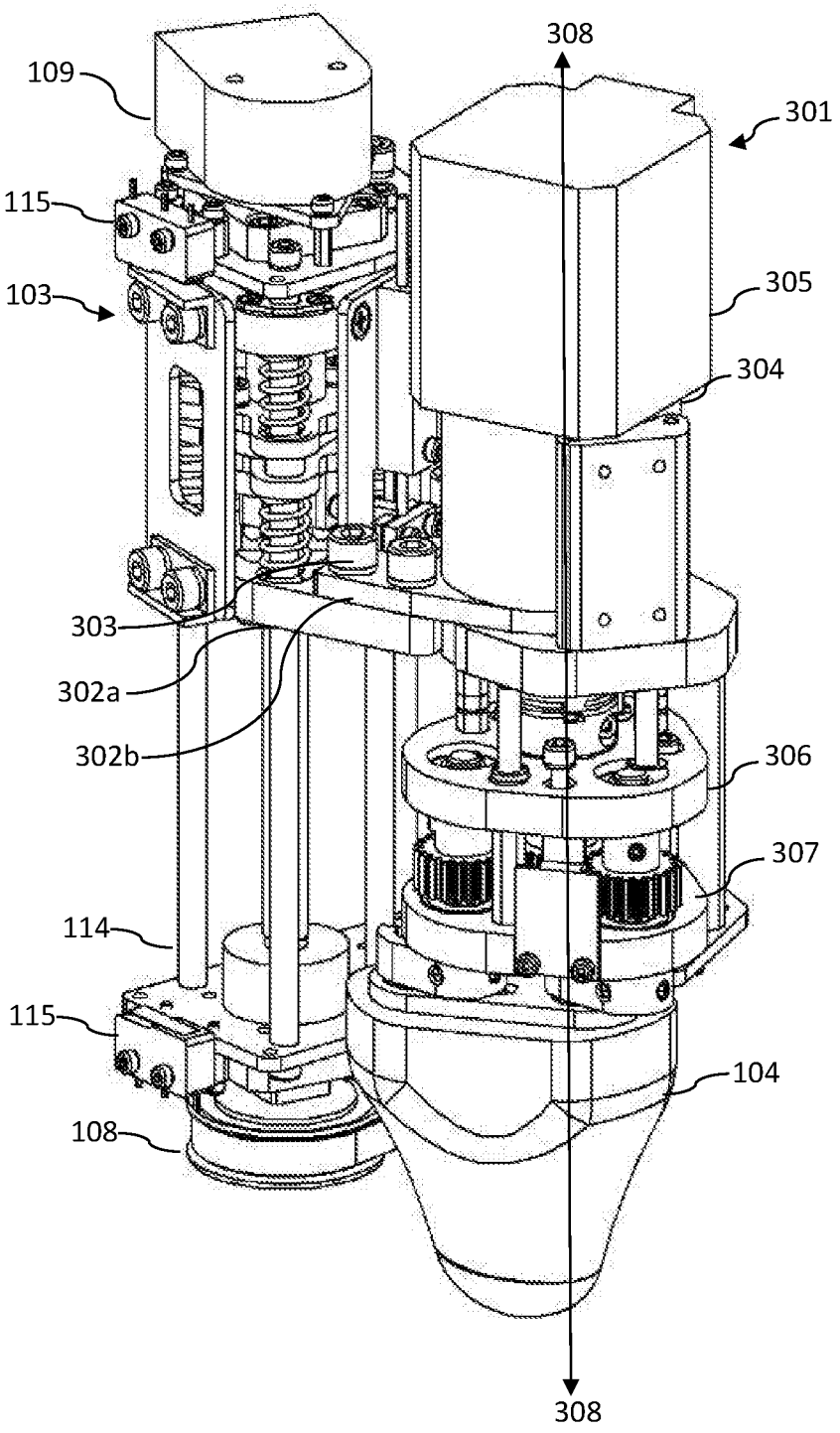
FIG. 3 depicts a perspective view of the massage apparatus according to an alternate embodiment of the invention.
Figure 4:
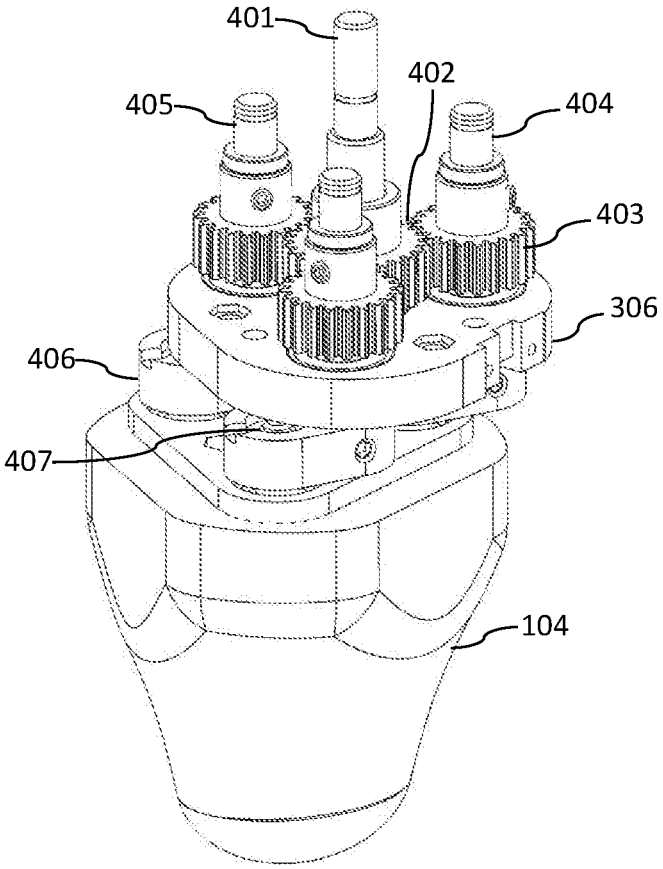
FIG. 4 depicts the transmission of the rotation module.

Referring to FIGS. 3 and 4, the massage apparatus may further comprise a rotation module 301 that connects movable block 103 to massage head 104. The rotation module 301 is fastened to the movable block by bolt 303 and overlapping segments 302*a* and *b* of supporting structure. The rotation module comprises motor 304 transmits rotational motion by way of drive shaft 401 defining a second axis 308 to main shaft pulley 402 which terminates at lower plate 306. The main shaft pulley 402 is mechanically linked to follow shaft pulleys 403 via cogs which are present on either pulley. While the drawings depict three follow shaft pulleys, the use of a plurality of follow shaft pulleys is within the scope contemplated by the present invention. The follow shaft pulleys 403 in turn transmit rotational motion to follow shafts 406 which extend through lower plate 306 and are attached to cranks 406 which in turn are each movably attached to massage head 104 by crank shafts 407 at an offset such that when motor 304 is powered, massage head 104 revolves about the second axis 308. In some embodiments, the main shaft pulley 402 is mechanically linked to a single follow drive pulley 403 via a chain or a belt and both the drive shaft 401 and follow shaft 406 extend through lower plate 306 to communicate rotational motion to the massage head 114. The cogs, the chain, or the belt as described above constitute a linking means.

Figure 5:
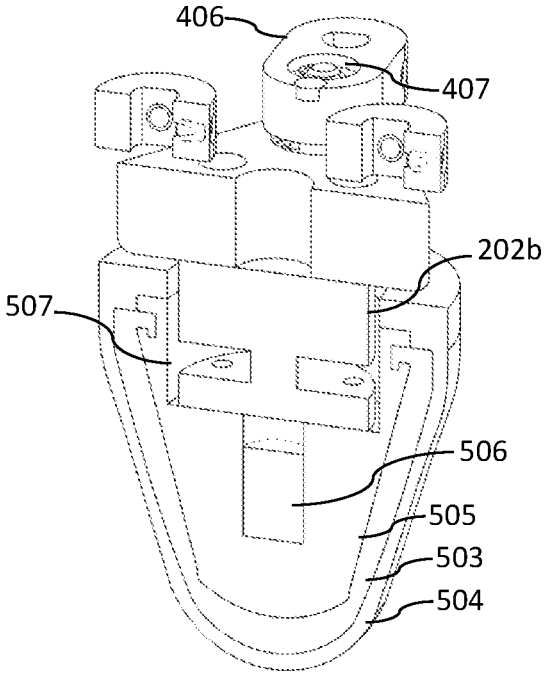
FIG. 5 depicts a cross-sectional view of the massage head.

Referring to FIG. 5, the massage head comprises a hard outer layer 504, a soft inner layer, 505, a force sensor 202*b*, a vibration motor 506 and a heating layer 503 having a heating element and a temperature sensor.

The hard outer layer 504 is primarily medical-grade silicone, silicone rubber, polyethylene terephthalate (PET), thermoplastic polyurethane (TPU) with a Shore Hardness of 80-100 on the OO scale while the soft inner layer 505 is silicone, rubber, silicone rubber, thermoplastic elastomers (TPE), thermoplastic polyurethane (TPU) with a Shore Hardness of less than 80 on the OO scale. The force sensor 202*b* is partially encapsulated in a compartment 507 within the soft inner layer 505. In some embodiments the compartment 507 is lined with hard a hard inner layer (not depicted) which has been found to improve the accuracy of force sensor readings over compartment 507 without the hard inner layer. The hard inner layer is primarily medical-grade silicone, silicone rubber, polyethylene terephthalate (PET), thermoplastic polyurethane (TPU) with a Shore Hardness of 80-100 on the OO scale. A skilled addressee will appreciate that any material exhibiting a Shore Hardness as specified above may be suitable substitutes. The heating element is configured to heat the massage head to a temperature slightly higher than that of the human body or approximately 40 degree Celsius.

The massage head 114 may be shaped to resemble a part of the human body such as a palm as depicted in FIG. 1 or a finger as depicted in FIG. 3. A skilled addressee would understand that the massage head 114 may be shaped to resemble any body part used in a massage routine such but not limited to feet, elbows, forearms or knees.

The invention claimed is:

1. A massage apparatus for use as a robot end effector comprising: a support structure, a movable block comprising an outer stage and an inner stage that are compressible towards each other along an axis, the moving block movably disposed within the support structure, a massage head attached to the movable block, a force sensor and a microcontroller; wherein the microcontroller is configured to dynamically reposition the movable block along the axis to maintain an applied force within a predetermined range in response to applied force readings transmitted by the force sensor; and further comprising a rotation module, the rotation module connecting the massage head to the movable block, the rotation module having a main shaft pulley and a follow shaft pulley mechanically linked thereto via a linking means, the main shaft pulley and/or follow shaft movably attached to the massage head such that the massage head revolves about the axis.

2. The massage apparatus according to claim 1, further comprising an elastic means set in between the outer stage and the inner stage.

3. The massage apparatus according to claim 1, wherein the force sensor is functionally disposed within the massage head.

4. The massage apparatus according to claim 2, wherein the applied force readings are determined by measuring the deflection of the elastic means.

5. The massage apparatus according to claim 1, further comprising a transmission for providing motive force to the movable block, the transmission having belt and pulley wherein the belt is functionally compromised when the applied force exceeds a predetermined value.

6. The massage apparatus according to claim 5, wherein the massage head comprises a hard outer layer, and a soft inner layer such that the force sensor is partially encapsulated within a compartment in the soft inner layer.

7. The massage apparatus according to claim 6, further comprising an inner hard layer disposed between the compartment and the force sensor.

8. The massage apparatus according to claim 1, further comprising two additional shaft pulleys.

9. The massage apparatus according to claim 1, wherein the linking means is selected from a group consisting of a belt, a chain or cogs.

10. The massage apparatus according to claim 1, wherein each main shaft pulley and/or follow shaft pulley is movably attached to the massage head by way of a crank.

* * * * *